United States Patent [19]

Perkins

[11] Patent Number: 4,499,948

[45] Date of Patent: Feb. 19, 1985

[54] VISCOUS OIL RECOVERY USING CONTROLLED PRESSURE WELL PAIR DRAINAGE

[75] Inventor: Thomas K. Perkins, Dallas, Tex.

[73] Assignee: Atlantic Richfield Company, Los Angeles, Calif.

[21] Appl. No.: 560,695

[22] Filed: Dec. 12, 1983

[51] Int. Cl.[3] ..... E21B 43/24

[52] U.S. Cl. ..... 166/248; 166/268

[58] Field of Search ..... 166/248, 268, 272, 60, 166/65 R, 245

[56] References Cited

U.S. PATENT DOCUMENTS

| | | | |
|---|---|---|---|
| 2,801,090 | 7/1957 | Hoyer et al. | 166/60 |
| 3,272,261 | 9/1966 | Morse | 166/245 |
| 3,848,671 | 11/1974 | Kern | 166/248 |
| 3,931,856 | 1/1976 | Barnes | 166/272 |
| 3,948,319 | 4/1976 | Pritchett | 166/248 |
| 4,010,799 | 3/1977 | Kern et al. | 166/248 |
| 4,084,637 | 4/1978 | Todd | 166/248 |
| 4,320,801 | 3/1982 | Rowland et al. | 166/248 |

FOREIGN PATENT DOCUMENTS

| | | | |
|---|---|---|---|
| 1031689 | 5/1978 | Canada | 166/248 |

*Primary Examiner*—Stephen J. Novosad
*Assistant Examiner*—Bruce M. Kisliuk
*Attorney, Agent, or Firm*—M. David Folzenlogen

[57] ABSTRACT

A relatively closely spaced injection well and production well pair is used as a single electrode and is used in a way that significantly increases the effective radius of an electrode production location. This is achieved by appropriately spacing of the wells and flowing aqueous fluid between wells at a pressure below the pressure driving oil toward the production well. The controlled pressure flowing aqueous fluid forms a highly conductivity flow path for oil flowing toward the production well. The effectiveness of the increased well pair drainage radius is achieved or augmented by injecting aqueous fluid, preferably steam or hot water, into the formation at a pressure great enough to drive oil toward the well pair and using the formation injection well as an electrode for electrically heating the oil. More than one well pair may be used either as a separate or the same electrode. One injection well or one production well may be used to form two or more well pairs. Several well pairs may be used in a suitable producing and injection pattern.

11 Claims, 4 Drawing Figures

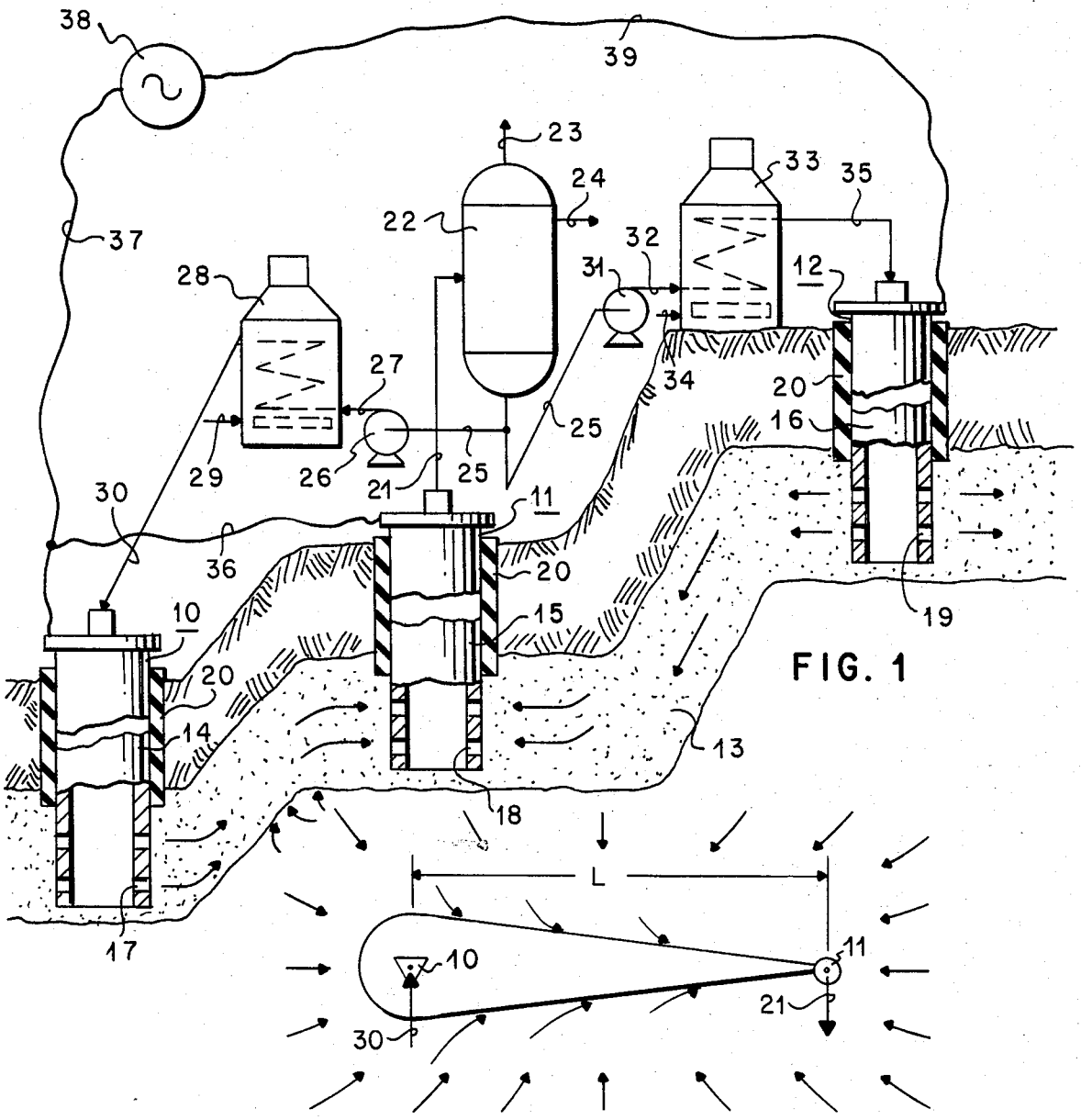
FIG. 1
FIG. 2
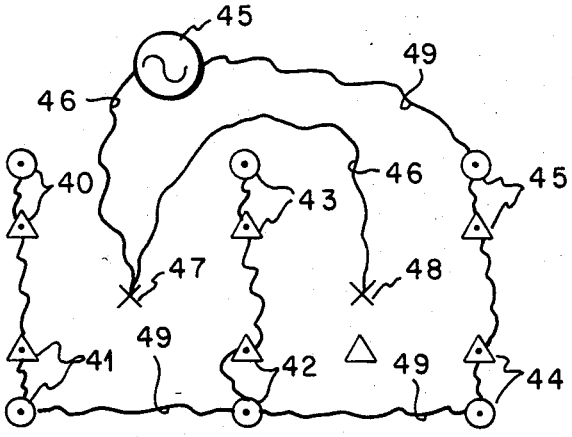
FIG. 3
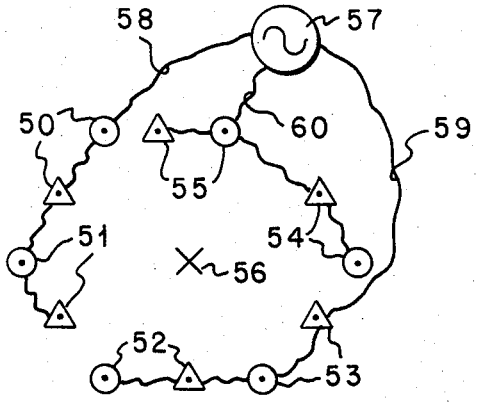
FIG. 4

VISCOUS OIL RECOVERY USING CONTROLLED PRESSURE WELL PAIR DRAINAGE

BACKGROUND OF THE INVENTION

This invention pertains to an improved electrical formation heating and viscous oil producing process. More particularly, in an electrical heating, oil producing process, controlled pressure aqueous fluid flow between a closely spaced well pair is used to significantly increase the effective radius of an oil production location. The production well pair is also used as a combined enlarged formation heating electrode.

Large relatively shallow deposits of viscous hydrocarbonaceous substances whose viscosity is decreased by heat are known to exist in subterranean formations. Many techniques have been proposed for producing oil from the viscous oil bearing formations. It has been proposed, for example, in U.S. Pat. Nos. 3,642,066; 3,874,450; 3,848,671; 3,931,856; 3,948,319; 3,958,636; 4,010,799; and 4,084,637, to use electrical current to add heat to a subsurface pay zone containing viscous oil. Electrodes are connected to an electrical power source and are positioned at spaced apart points in contact with the earth, for example, in the formation. Electrical current flow through the formation heats the oil by electric power dissipation. Frequently, in electrical well heating, most of the energy is dissipated near the electrode surfaces. It has been suggested that saltwater be injected to increase the effectiveness of a subsurface electrode. For example, in U.S. Pat. No. 3,931,856 salt water is injected between an injection well and satellite wells to increase the effective size of an electrode injection well. This process involves injection pressures above the formation pressure and does not pertain to increasing the effective radius of a producing location.

Oil production depends on a driving force or pressure differential between the formation and the producing well. As oil is produced from the formation, this driving force is depleted and oil production may stop. It has been proposed to inject various fluids which will maintain the pressure of the formation and drive the oil toward the producing well. During oil production, the greatest pressure drop occurs as the oil approaches the wellbore. Reservoir calculations use a concept called the effective radius of the borehole. Various techniques have been proposed to increase the effective radius of a producing location. For example, it has been proposed to create highly conductive fractures in the formation to increase the effective radius of a producing well. Fracturing requires injection pressures above the formation pressure. Moreover, viscous oil bearing formations are typically unconsolidated and fractures rapidly close and seal themselves if the injection pressure is decreased. It has been proposed to prop fractures with various forms of solid propping agents in a manner such that the fracture retains some of its relatively high conductivity to fluid flow. But in unconsolidated formations, fracture propping is difficult to achieve successfully. The unconsolidated tar-like nature of the walls of the fracture will simply close around and extrude into pores between the multilayers of propping agents, thereby sealing the fracture.

It is the primary objective of this invention to provide an improved method of increasing the effective radius of a production location in a way that does not require continued use of injection pressures above the pressure of the formation forcing oil toward the production location.

SUMMARY OF THE INVENTION

This invention provides an improved electrical heating method of recovering viscous oil from a subterranean formation via an electrode production location. This invention utilizes a relatively closely spaced aqueous fluid injection well and an oil-water production well pair in a way that significantly increases the effective radius of the production well while also increasing the electrical conductivity of the formation about the producing location where the current flux is great and thereby makes possible use of larger currents than would otherwise be practical with a given voltage differential. The closely spaced well pair provides additional advantages, but the primary focus is on the increased effective radius of the production location. The increased effective radius is achieved by appropriately spacing the injection well and the production well from each other in a manner such that water, or condensed or partially condensed steam, may be flowed between the wells at a pressure below the natural or induced remote formation pressure driving oil toward the production well. The controlled pressure flowing aqueous fluid forms a high conductivity flow path for oil flowing toward the relatively closely spaced injection and production well pair. The well pair are also electrically connected to each other by suitable metallic conductors and are used as a single electrode location for passing electrical current through an appropriate part of the formation. The circulation of aqueous fluid between the wells increases the effective size of the electrode and reduces resistance to current flow at the producing location. In addition, the circulating aqueous fluid provides a medium for transferring heat toward the producing well where the greatest amount of appropriate heat is desired. In situations where the well pair spacing is such and electrical power dissipation is insufficient to keep the viscosity of the oil flowing into increased drainage area low, the aqueous fluid will be heated at the surface. This also adds additional heat to the formation. The effectiveness of the increased well pair drainage radius is augmented by injecting fluid into the formation at a more remote point and at a pressure great enough to drive oil toward the well pair production location. The more remote injection well location may also be used as an electrode for electrically heating the oil between the producing location and the more remote injection well. In addition, more than one well pair may be used either as a separate or the same electrode and one injection well in a well pair may be used to form two or more well pairs with an appropriate number of producing wells. If a plurality of well pairs are provided, they may be used in a suitable producing or electrical heating pattern.

BRIEF DESCRIPTION OF THE DRAWINGS

FIG. 1 is a side elevational view, partly schematic and partly in section illustrating one arrangement for carrying out the process of this invention.

FIG. 2 is a top schematical plan view of a well pair illustrating the increased effective radius of a producing location.

FIG. 3 is a schematical top plan view of a single phase alternating current system wherein the remote injection wells are connected as one electrode and a series of well pairs laid out in a five spot pattern are used as a single electrode.

FIG. 4 is a schematical top plan view of three phase electrical alternating current wherein well pairs arranged in a seven spot pattern are used as three electrodes.

DETAILED DESCRIPTION OF PREFERRED EMBODIMENTS

The process of the present invention is adaptable to be practiced in any formation containing viscous oils whose viscosity is susceptible to significant reduction and increased mobility at temperatures achievable by electrical formation heating with or without the addition of hot water or steam. The maximum benefits of the process apply primarily to formations where the oil has an API gravity of less than 20.

Referring now to FIG. 1, there are illustrated three wells 10, 11 and 12 extending downward from the surface into well boreholes drilled into oil bearing formation 13. The wells are spaced laterally apart from each other in any direction. The relative lateral spacing is significant as hereinafter discussed. At this point, suffice it to say that the distance between wells 10 and 11 is significantly less than the distance between production well 11 and remote injection well 12. The wells may be completed in any manner suitable for the purposes hereinafter stated, for example, in the manner set forth in co-pending application Ser. No. 509,839, filed June 30, 1983, entitled "Well Completion for Electrical Power Transmission", and owned by a common assignee. Wells 10 and 11 form a relatively closely spaced production location well pair and may be completed for injection or production or for switching between the two. Well 12 is optional and is completed for injection at a more remote spot. If well 12 is used, water, hot water or brine, or steam will be injected into the formation at a pressure significantly greater than the injection pressure used between wells 10 and 11 when the well pair is operated in accordance with this invention. For illustration purposes, each well is shown only with casing strings 14, 15 and 16, but it is to be understood that the wells may contain tubing, packers and other conventional equipment. The casings are perforated with perforations 17, 18 and 19 into the formation. The well casings are shown electrically insulated from the overburden above formation 13 by insulation 20 to reduce undesirable power losses to the overburden. Well 11 is illustrated as a producing well where the formation fluids are flowed, lifted or pumped to the surface exiting the well through production flow line 21. The produced fluids are separated in the usual fashion in separator 22. For illustrative purposes, produced gases exit the separator through overhead line 23 and oil exits the separator through oil delivery line 24 where the oil is passed to storage or other handling facilities (not shown). Produced waters exit the separator through line 25 where all or part of the water may be pumped via pump 26 through line 27 into optional well-pair heater 28 where it may be heated to an appropriate temperature or turned into steam by burning fuel entering through fuel line 29. The aqueous fluid is flowed through line 30 to injection well 10. As an alternative all or part of the water produced by the separator may be pumped via the pump 31 and line 32 through optional remote injection heater 33. In the heater, the water may be heated to an appropriate temperature or it may be turned into steam by burning fuel entering through fuel line 34. The hot aqueous fluid exiting the heater is passed through line 35 and is injected into injection well 12. Wells 10 and 11 are shown electrically connected to each other by suitable electrically conductive metallic wiring or members 36 and 37 which are also connected to power source 38. Similarly, well 12 is shown connected through a suitable metallic conductor 39 to power source 38, but remote injection well 12 need not be used as an electrode and other electrodes for the application of electric power to the formation may be other well pairs in an appropriate pattern.

Power source 38 may produce DC, pulsating DC, or single or poly-phase eccentric or regular AC of any suitable number of cycles per second. Poly-phase eccentric or regular alternating current is much preferred for its greater efficiency. Preferably, the well tubing or casing of each electrode well or well pair will act as the electrode, but separate electrodes may be installed into each electrode well. When electric current is passed from the power source through the wells and into the formation, its magnitude duration may be controlled by suitable switching and voltage control means (not illustrated).

In operation, an aqueous fluid, preferably steam or hot brine, is injected into injection well 10 at a predetermined pressure in a manner such that some or all of the aqueous fluid flows from the injection well through the formation and into production well 11. The predetermined injection pressure is such that the passage of aqueous fluid through the formation will not prevent oil from being forced or driven by more remote formation or injection pressures into the well pair production location. Therefore, the injection pressure is less than the formation pressure which forces or drives oil toward the production well. This pressure may be determined in a number of conventional ways. One way is to measure the pressure at a remote spot which is considered within the drainage radius of the well pair production location. Another method is to shut-in the well pair production location and other wells that affect the measurement of formation pressures and then conduct conventional pressure build up curves in the production well. This will indicates the shut-in formation pressure at the production well. Normally this will be done before the well pair is put into operation because in unconsolidated formations it is generally not desirable to cease the flow of aqueous fluid once it has been commenced. The appropriate injection pressure can be accomplished at the surface by simply monitoring oil and water (with or without tracers) production rates in the producing well of the well pair.

Sometimes it will not be feasible to initiate aqueous fluid flow between the well pair immediately at the necessary controlled pressure. The area of the formation between the injection well and production well pair may require prior preparation. In such situations, an aqueous fluid, preferrably steam or hot brine, may be injected into injection well 10, or into producing well 11 or, into both wells simultaneously or alternately, to create a path for flow of aqueous fluid between the production well and the injection well. When creating the initial flow path between the wells, any suitable injection pressure may be used. However, once the flow path has been created, the producing well will be placed on production and the injection well will be used to inject and flow aqueous fluid (preferably hot brine or steam) at the controlled pressure into the formation and thence into the production well. If steam is injected it will condense in the formation and for the most part only water will be flowed in the production well. The highly conductive flow path created for the flow of aqueous fluid between the well pair allows the aqueous fluid to be flowed at a pressure lower than the driving pressure in the formation. This can be further accomplished by using chokes, intermitters or other pressure control means in the injection well or by using artificial lift means at the production well which create a point of reduced pressure, or both means may be used. When the conductive flow path is created and the wells are placed into operation in accordance with the principals of this disclosure, the flow of aqueous fluid will form a flow pattern similar to that illustrated in FIG. 2 provided that only a single pair of wells are used, If, for example, one injection well is used to form two or more pairs with two or more closely spaced production wells, the flow pattern will be different, but in any case the aqueous fluid will flow into the production well creating a highly conductive fluid flow path thereby increasing the effective radius of the producing location. Accordingly, for illustrative purposes, aqueous fluid injected through line 30 flows into injection well 10 and spreads out into the formation in a circular fashion with lines of flow extending from the circular path in a narrowing line to production well 11 where the water and oil are flowed to the surface exiting the well through production line 21. Oil flowing toward this dual well production location moves towards the highly conductive flow path created by the flowing aqueous fluid and some of the oil enters the lower pressure highly conductive flow path of flowing aqueous fluid where it is entrained in or driven by the aqueous fluid and flows with it into production well 11. Other portions of the oil from the formation flow directly toward production well 11 and enter the production well along with the flowing injected aqueous fluid. In this manner, the well pair increases the effective radius of the production location and increases the rate of oil flow significantly. The degree of increase in productivity index is partially dependent upon the well spacing of the well pair. In FIG. 2, this distance of lateral well spacing is designated by the dimension "L". For example, if it is assumed that formation oil is flowed to the production location from a radius of a thousand feet without electric heating and that a single well has a radius of 0.25 foot, for a single well pair well spacing of 25 feet the productivity index ratio over a single producing well is calculated to be 1.89, for 50 feet the productivity index ratio is 2.25, for 100 feet the productivity index ratio is 2.76, and for 200 feet the productivity index ratio is 3.6. The degree of increase is also dependent on the number of well pairs used and on the amount of electric power dissipated in the producing area of the formation. For example, in comparison to the above if it is assumed that the electrical heating raises the temperature of the oil a few tens of degrees and two well pairs are used, for a 25 feet well pair spacing the productivity index ratio over a single producing well is calculated to be 9 to 18, for 50 feet the productivity index ratio is 11 to 22, for 100 feet the productivity index ratio is 14 to 28, and for 200 feet the productivity index ratio is 18 to 36. Distance "L" is significantly less than the distance between producing well 11 and remote injection well 12. Preferably, the distance between remote injection well 12 and production well 11 will be at least two times the distance "L" between the wells in the well pair.

Preparation of the producing area will include selection of the desired number of wells and well patterns to be used to produce the oil. This selection will partially depend upon the type of electrical power used and the number of phases involved if alternating current is to be used. For example, direct current may be used in some parts of the formation which have certain types of resistivity while alternating current is applied in other parts. Because the brine or condensing or condensed steam will be flowed between electrode well pairs and because the brine or condensing or condensed steam will be injected at the remote injection sites, it is anticipated that only alternating current will be used since it is more efficient. For illustrative purposes, FIGS. 3 and 4 have been included to show different well patterns and different methods of connecting the electrodes. These are merely illustrative of the fact that there are a number of different ways that the combined electrode-producing location well pairs of this invention may be used. In FIG. 3, the well pairs are placed in a typical five spot pattern. Six well pairs 40, 41, 42, 43, 44 and 45 are used for two five spot patterns. Each pattern has a centralized injection well for applying driving pressure or force to the oil. For illustrative purposes, single phase AC power source 45 is illustrated. One leg of the power source is connected via conductor 46 to injection wells 47 and 48 and the other leg is connected via conductor 49 to all of the production location well pairs. In FIG. 4, six well pairs 50, 51, 52, 53, 54 and 55 are illustrated in a typical seven spot pattern with central injection well 56 for applying pressure and/or heat to the formation. Three phase alternating current source 57 is illustrated. Well pairs 50 and 51 are connected via conductor 58 to one leg of the three phase power source. Similarly, well pairs 52 and 53 are connected via conductor 59 and well pairs 54 and 55 are connected via conductor 60 to other legs of power source 57. In all of the illustrations, each well pair was comprised of an injection well and a producing well; however, it is to be understood that a well pair may be comprised of more than two wells provided that an injection well is used to flow aqueous fluid into a producing well.

For example, in FIG. 1, a second production well (not shown) could be provided on the opposite side of and spaced laterally from injection well 11. The lateral spacing would be significantly less than the lateral distance between the second production well and remote injection well 12. The second production well would be electrically connected to injection well 10 in the same manner that wells 10 and 11 are connected. Aqueous fluid would be flowed between injection well 10 and the second production well in a manner similar to the way aqueous fluid is flowed between wells 10 and 11. By way of further example, as shown in FIG. 4, well pair 50 and well pair 54 having characteristics similar to those previously described may be provided and the electric current may be passed between the two well pairs through the formation. Injection well 56 forces oil toward both well pairs.

From the foregoing, it can be seen that this disclosure achieves the purposes previously mentioned and that this invention is suitable for use in many prior art processes. Although this invention has been described with a certain degree of particularity, it is understood that the present disclosure has been made only by way of example and that numerous changes in the details of construction and the combination and arrangement of parts may be resorted to without departing from the spirit and the scope of this invention.

I claim:

1. A method of recovering viscous oil from a subsurface formation comprising the steps of:

a. providing a first injection well and a first production well which extend into and communicate with said formation, said first injection well and said first production well being spaced laterally one from the other by a predetermined first distance, said first injection well and said first production well being electrically connected to each other by an electrically conductive metallic flow path;

b. injecting aqueous fluid into said first injection well at a predetermined first pressure in a manner such that said aqueous fluid flows from said first injection well through said formation and into said first production well, said first pressure being below the shut-in formation pressure of said first production well; and c. passing electrical current from said first production well and said first injection well through at least a part of said formation.

2. The method of claim 1 wherein prior to step "b" the method includes the step of injecting an aqueous fluid into at least one of said first production wells and said first injection well to create a path for flow of aqueous fluid between said first production well and said first injection well.

3. The method of claim 1 wherein there is provided a second production well spaced laterally from said first injection well, said second production well being electrically connected to said first injection well by an electrically conductive metallic flow path and the aqeuous fluid is also flowed between said first injection well and said second production well.

4. The method of claim 1 wherein the method includes the following steps:

d. providing a second injection and production well pair which extend into and communicate with said formation, said wells in said second well pair being spaced laterally one from the other by a predetermined second well pair distance, said second well pair being spaced laterally from said first production and first injection wells by a distance substantially greater than said second well pair distance and said first distance between said first production and first injection wells, said second well pair being electrically connected to each other by an electrically conductive metallic flow path;

e. injecting an aqueous fluid into one of the wells of said second well pair at a predetermined second well pair pressure in a manner such that said aqueous fluid flows between the wells of said second well pair through said formation, said second well pair pressure being below the shut-in formation pressure of the production well of said second well pair; and f. passing electrical current from said second well pair to said first production and said first injection wells.

5. The method of claim 1 wherein the method includes the following step:

d. injecting an aqueous fluid into a remote injection well at a predetermined second pressure, said second pressure being significantly greater than said first pressure, said remote injection well being spaced laterally from said first production well by a predetermined second distance, said second distance being substantially greater than said first distance between said first production well and said first injection well.

6. The method of claim 5 wherein said second distance is at least two times said first distance.

7. The method of claim 6 wherein there is provided a second production well spaced laterally from said first injection well by a distance which is less than one half of said second distance, said second production well being electrically connected to said first injection well by an electrically conductive metallic flow path and the aqueous fluid is flowed between said first injection well and said second production well.

8. The method of claim 5 wherein electric current is passed from said remote injection well through at least a part of said formation to said first production well and said first injection well.

9. The method of claim 8 wherein there is provided a second production well spaced laterally from said first injection well by a distance which is less than one half of said second distance, said second production well being electrically connected to said first injection well by an electrically conductive metallic flow path and the aqueous fluid is flowed between said first injection well and said second production well.

10. A method of claim 5 wherein the method includes the following steps:

e. providing a second injection well and a second production well which extends into and communicates with said formation, said second injection and said second production well being spaced laterally one from the other by a predetermined third distance, said second production well being spaced laterally from said remote injecting well by a fourth distance, said third distance being substantially less than said fourth distance, said second injection well and said second production well being electrically connected to each other by an electrically conductive metallic flow path;

f. injecting an aqueous fluid into said second injection well at a predetermined third pressure in a manner such that said aqueous fluid flows from said second injection well through said formation and into said second production well, said third pressure being below the shut-in formation pressure of said second production well, and significantly less than said second pressure, and g. passing electrical current from said second production and said second injection wells through at least a part of said formation to said first production and said first injection wells.

11. The method of claim 10 wherein the electric current is polyphase and electrical current is also passed through a part of said formation to said remote injection well.

* * * * *